US005310477A

United States Patent [19]

Lomas

[11] Patent Number: 5,310,477

[45] **Date of Patent: * May 10, 1994**

[54] FCC PROCESS WITH SECONDARY DEALKYLATION ZONE

[75] Inventor: David A. Lomas, Barrington, Ill.

[73] Assignee: UOP, Des Plaines, Ill.

[ * ] Notice: The portion of the term of this patent subsequent to Jan. 5, 2010 has been disclaimed.

[21] Appl. No.: 872,214

[22] Filed: Apr. 22, 1992

Related U.S. Application Data

[63] Continuation-in-part of Ser. No. 632,794, Dec. 24, 1990, Pat. No. 5,176,815.

[51] Int. Cl.[5] ..... C10G 51/06

[52] U.S. Cl. ..... 208/78; 208/113; 208/148; 208/151; 208/153; 208/155; 208/164; 208/163

[58] Field of Search ..... 208/153, 155, 164, 148, 208/163, 141, 74, 78, 113

[56] References Cited

U.S. PATENT DOCUMENTS

| | | | |
|---|---|---|---|
| 2,550,290 | 4/1951 | Pelzer et al. | 208/74 |
| 2,883,332 | 4/1959 | Wickham | 208/74 |
| 2,915,457 | 12/1959 | Abbott et al. | 208/74 |
| 2,921,014 | 1/1960 | Marshall | 208/74 |
| 2,956,003 | 10/1960 | Marshall et al. | 208/74 |
| 3,161,582 | 12/1964 | Wickham | 208/74 |
| 3,607,129 | 9/1971 | Carson | 23/288 S |
| 3,776,838 | 12/1973 | Youngblood et al. | 208/74 |
| 4,295,961 | 10/1981 | Fahrig et al. | 208/161 |
| 4,390,503 | 6/1983 | Walters et al. | 422/147 |
| 4,464,250 | 8/1984 | Myers et al. | 208/120 |
| 4,624,771 | 11/1986 | Lane et al. | 208/74 |
| 4,664,888 | 5/1987 | Castagnos, Jr. | 422/147 |
| 4,737,346 | 4/1988 | Haddad et al. | 422/144 |
| 4,789,458 | 12/1988 | Haddad et al. | 208/151 |
| 4,792,437 | 12/1988 | Hettinger, Jr. et al. | 422/147 |
| 4,793,915 | 12/1988 | Haddad et al. | 208/161 |
| 5,176,815 | 1/1993 | Lomas | 208/153 |

*Primary Examiner*—Helane Myers
*Attorney, Agent, or Firm*—Thomas K. McBride; John G. Tolomei

[57] ABSTRACT

FCC process uses an open reactor vessel to house cyclones or other separation devices that reduce the carry through of product gases with the catalyst into the reactor vessel to less than 10 wt. % so that the catalyst in the reactor vessel provides a secondary dealkylation zone. By using a highly efficient separation device to remove product from the catalyst, the environment in the reactor vessel receives a low volume of cracked hydrocarbons from the riser conversion zone and provides a convenient secondary reaction zone that receives a recycled heavy gasoline fraction separated from the riser product stream. Dealkylation in the secondary reaction zone provides additional light gasoline to satisfy T90 requirements.

16 Claims, 2 Drawing Sheets

FCC PROCESS WITH SECONDARY DEALKYLATION ZONE

CROSS-REFERENCE TO RELATED APPLICATIONS

This application i& a continuation in part of U.S. Ser. No. 632,794, filed on Dec. 24, 1990 now U.S. Pat. No. 5,176,815.

FIELD OF THE INVENTION

This invention relates generally to processes for the fluidized catalytic cracking (FCC) of heavy hydrocarbon streams such as vacuum gas oil and reduced crudes. This invention relates more specifically to a method for separately reacting a traditional FCC feedstream and a heavy gasoline feed in an FCC reaction zone.

BACKGROUND OF THE INVENTION

The fluidized catalytic cracking of hydrocarbons is the main stay process for the production of gasoline and light hydrocarbon products from heavy hydrocarbon charge stocks such as vacuum gas oils or residual feeds. Large hydrocarbon molecules, associated with the heavy hydrocarbon feed, are cracked to break the large hydrocarbon chains thereby producing lighter hydrocarbons. These lighter hydrocarbons are recovered as product and can be used directly or further processed to raise the octane barrel yield relative to the heavy hydrocarbon feed.

The basic equipment or apparatus for the fluidized catalytic cracking of hydrocarbons has been in existence since the early 1940's. The basic components of the FCC process include a reactor, a regenerator and a catalyst stripper. The reactor includes a contact zone where the hydrocarbon feed is contacted with a particulate catalyst and a separation zone where product vapors from the cracking reaction are separated from the catalyst. Further product separation takes place in a catalyst stripper that receives catalyst from the separation zone and removes entrained hydrocarbons from the catalyst by counter-current contact with steam or another stripping medium.

The FCC process is carried out by contacting the starting material whether it be vacuum gas oil, reduced crude, or another source of relatively high boiling hydrocarbons with a catalyst made up of a finely divided or particulate solid material. The catalyst is transported like a fluid by passing gas or vapor through it at sufficient velocity to produce a desired regime of fluid transport. Contact of the oil with the fluidized material catalyzes the cracking reaction. The cracking reaction deposits coke on the catalyst. Coke is comprised of hydrogen and carbon and can include other materials in trace quantities such as sulfur and metals that enter the process with the starting material. Coke interferes with the catalytic activity of the catalyst by blocking active sites on the catalyst surface where the cracking reactions take place. Catalyst is traditionally transferred from the stripper to a regenerator for purposes of removing the coke by oxidation with an oxygen-containing gas. An inventory of catalyst having a reduced coke content, relative to the catalyst in the stripper, hereinafter referred to as regenerated catalyst, is collected for return to the reaction zone. Oxidizing the coke from the catalyst surface releases a large amount of heat, a portion of which escapes the regenerator with gaseous products of coke oxidation generally referred to as flue gas. The balance of the heat leaves the regenerator with the regenerated catalyst. The fluidized catalyst is continuously circulated from the reaction zone to the regeneration zone and then again to the reaction zone. The fluidized catalyst, as well as providing a catalytic function, acts as a vehicle for the transfer of heat from zone to zone. Catalyst exiting the reaction zone is spoken of as being spent, i.e., partially deactivated by the deposition of coke upon the catalyst. Specific details of the various contact zones, regeneration zones, and stripping zones along with arrangements for conveying the catalyst between the various zones are well known to those skilled in the art.

The FCC unit cracks gas oil or heavier feeds into a broad range of products. Cracked vapors from the FCC reactor enter a separation zone, typically in the form of a main column, that provides a gas stream, a gasoline cut, cycle oil and heavy residual components. The gasoline cut includes both light and heavy gasoline components. A major component of the heavy gasoline fraction comprises heavy single ring aromatics.

Recent concerns about volatility and toxicity of hydrocarbon fuel and the resultant environment damage has prompted legislation that will limit the content and composition of aromatic hydrocarbons in such fuels. Some of these limitations relate specifically to benzene which, due to its toxicity, will be substantially eliminated from the gasoline pool. Restrictions on the content of heavy aromatics will result from proposed end boiling point limits of gasoline fuels, referred to as T90. T90 limits curtail the presence of hydrocarbon components that boil above temperatures in a range of about 350°–430° F. Therefore, a process is sought that will eliminate the presence of high boiling aromatics from FCC gasoline.

DISCLOSURE STATEMENT

U.S. Pat. No. 2,883,332 describes the use of two separate bed type reaction zones in an FCC process and the charging of a recycle stock to one of the reaction zones and the recovery of the product streams from both of the reaction zones through a common recovery system.

U.S. Pat. No. 3,161,582 teaches the use of riser reaction zone that converts a first feed and discharges the converted feed into a second bed type reaction zone that treats additional more refractory feed. All of the converted feeds are recovered from a common dilute phase collection zone in the reactor.

U.S. Pat. No. 2,550,290 discloses an FCC process that contacts an FCC charge oil in a first reaction vessel, separates the products from the first reaction vessel, and contacts the bottoms stream from the product separation in a separate second reaction vessel.

U.S. Pat. No. 2,915,457 describes the treatment of an FCC feed in a first riser type catalytic cracking vessel, separation of cracked hydrocarbons from the first vessel into a gasoline product, a heavy residual stream and a gas oil stream, hydrotreating of the gas oil stream, cracking of the hydrotreated gas oil in a second reaction vessel and recycling of gas oil and heavier cracked components in the second reaction vessel.

U.S. Pat. Nos. 2,956,003 and 2,921,014 teach an FCC process and the use of a riser type reaction vessel for the conversion of an FCC feed separation of converted feed and a separate dense bed reaction vessel for the conversion of the separated bottoms stream.

U.S. Pat. No. 3,607,129 shows an apparatus for cracking a heavy FCC feedstock in a riser conversion zone, discharging the cracked product into an FCC reactor vessel, cracking hydrotreated or inhydrotreated light cycle oil in a fluidized catalyst bed in a lower portion of the reaction vessel and withdrawing the cracked products from the riser and the dense bed through a common conduit.

U.S. Pat. No. 3,766,838 shows the cracking of naphtha stream in a fluidized catalytic cracking process.

U.S. Pat. Nos. 4,390,503 and 4,792,437 disclose ballistic separation devices.

U.S. Pat. No. 4,295,961 shows the end of a reactor riser that discharges into a reactor vessel and an enclosure around the riser that is located within the reactor vessel.

U.S. Pat. No. 4,737,346 shows a closed cyclone system for collecting the catalyst and vapor discharge from the end of a riser.

U.S. Pat. No. 4,624,771, issued to Lane et al. on Nov. 25, 1986, discloses a riser cracking zone that uses fluidizing gas to preaccelerate the catalyst, a first feed introduction point for injecting the starting material into the flowing catalyst stream, and a second downstream fluid injection point to add a quench medium to the flowing stream of starting material and catalyst.

U.S. Pat. No. 4,664,888, issued to Castagnos and U.S. Pat. No. 4,793,915 issued to Haddad et al., show baffle arrangements at the end of an upwardly discharging riser. The '915 patent shows the introduction of steam into the baffle arrangement for stripping catalyst that flows downward from the riser.

U.S. Pat. No. 4,464,250, issued to Maiers et al. and U.S. Pat. No. 4,789,458, issued to Haddad et al., teach the heating of spent catalyst particles to increase the removal of hydrocarbons, hydrogen and/or carbon from the surface of spent catalyst particles by heating the catalyst particles after initial stripping of hydrocarbons in the stripping zone of an FCC unit.

U.S. Pat. No. 5,082,983 teaches the introduction of light reformate stream into an FCC riser.

BRIEF DESCRIPTION OF THE INVENTION

An object of this invention is the additional cracking of heavy gasoline components at high severity to reduce the end point of FCC gasoline with an improved FCC arrangement.

This invention is an FCC process that treats an FCC feed such as gas oils or residual hydrocarbons in a riser reaction zone to produce a riser effluent stream that after separation provides a heavy gasoline feed fraction to an isolated dense catalyst bed in the reactor vessel. Contact in the dense bed further dealkylates heavy aromatics to $C_7$ and $C_8$ aromatics. The riser discharges catalyst and vapor into a separation device at the end of a riser which separates catalyst from gas that exits the end of the riser and effects a very low transfer of riser vapors into the reactor vessel so that the dense bed of catalyst in the reactor vessel acts as an independent treating zone for the dealkylation of the heavy gasoline. The arrangement allows vapors from the riser reaction zone to remain isolated from the reactor vessel vapors until after an essentially complete separation of the riser vapors from the catalyst.

The arrangement also provides dramatically different modes of operation in the reactor riser and the reactor vessel. The riser and enclosed separation system provides a short contact time and limited catalyst to hydrocarbon ratios for reactants passing therethrough. Conversely, reactants in the reactor vessel furnishe a relatively long catalyst contact time and a high catalyst to hydrocarbon ratio. Thus, the short contact time riser conditions favor highly reactive monomolecular reactions whereas, the longer contact times with the partially deactivated catalyst in the reactor vessel favor the cracking and dealkylation of the less reactive components and certain bimolecular reactions. These reactions promote the necessary partial dealkylation of the heavy monocyclic aromatics which reduces boiling point while still limiting the production of unwanted benzene. Thus, this invention applies independent control of two separate reaction zones within one FCC reactor to convert heavy gasoline to more environmentally acceptable gasoline fuel.

Accordingly, in one embodiment this invention is a process for the fluidized catalytic cracking (FCC) of an FCC feedstock and the production of low boiling end point gasoline. The process passes an FCC feedstock and regenerated catalyst particles to a reactor riser and transports the catalyst and feedstock upwardly through the riser thereby converting the feedstock to a riser gaseous product stream and producing partially spent catalyst particles by the deposition of coke on the regenerated catalyst particles. The riser discharges a mixture of partially spent catalyst particles and gaseous products from a discharge end of the riser directly into a separation zone. The separation zone recovers at least 90 wt. % of the gaseous products from the riser that enter the separation zone. A first gas outlet withdraws the recovered riser gaseous products from the separation zone. The process separates the riser gaseous products from the first outlet into a product stream comprising light gasoline having an end boiling point at a first temperature in a range of 300° to about 400° F., a heavy gasoline feed having an initial boiling point at about said first temperature and an end boiling point at a second temperature above 400° F. and a first cycle oil stream having an initial boiling point at about said second temperature. The separation zone passes the partially spent catalyst and not more than 10 wt. % of the reactor riser gaseous products into a reaction vessel that maintains a dense bed of catalyst in the reaction vessel and contacts the heavy gasoline feed with the partially spent catalyst in the dense bed of the reaction vessel to produce a reactor vessel product stream. A second outlet withdraws at least 90 wt. % of the reactor vessel product stream from the reactor vessel and passes spent catalyst from the reactor vessel into a regeneration zone and contacts the spent catalyst with a regeneration gas in the regeneration zone to combust coke from the catalyst particles and produce regenerated catalyst particles for transfer to the reactor riser. The reactor vessel product stream undergoes separation to recover additional light gasoline product having an end boiling point below said second temperature.

In another aspect of this invention, a light cycle oil stream having an end boiling point in a range of 500°-650° F. is separated from the riser gaseous products and is contacted with catalyst in the dense bed of said reaction vessel. The light cycle oil may pass through a hydrotreating zone before entering the dense bed of said reaction vessel.

In another aspect of this invention, the riser product stream enters a first separation zone, the reactor vessel product stream enters a second separation zone, and a second product stream comprising a gasoline stream having an end boiling point in a range of from 320° to about 400 ° F. is withdrawn from the second separation zone.

In another aspect of this invention, a benzene containing stream is passed to the dense bed of the reaction vessel and alkylated to produce $C_7$ and $C_8$ aromatics. The benzene stream may be a light reformate stream.

Other objects, embodiments and details of this invention are set forth in the following detailed description of the invention.

DETAILED DESCRIPTION OF THE INVENTION

This invention relates generally to the reactor side of the FCC process. This invention will be useful for most FCC processes that are used to crack light or heavy FCC feedstocks. The process of this invention can be used to modify the operation and arrangement of existing FCC units or in the design of newly constructed FCC units.

This invention uses the same general elements of many FCC units. A reactor riser provides the primary reaction zone. A reactor vessel with a catalyst separation device removes catalyst particles from the gaseous product vapors. A stripping zone removes residual adsorbed hydrocarbons from the catalyst. Spent catalyst from the stripping zone is regenerated in a regeneration zone having one or more stages of regeneration. Regenerated catalyst from the regeneration zone re-enters the reactor riser to continue the process. A number of different arrangements can be used for the elements of the reactor and regenerator sections. The description herein of specific reactor and regenerator components is not meant to limit this invention to those details except as specifically set forth in the claims.

Figure 1:
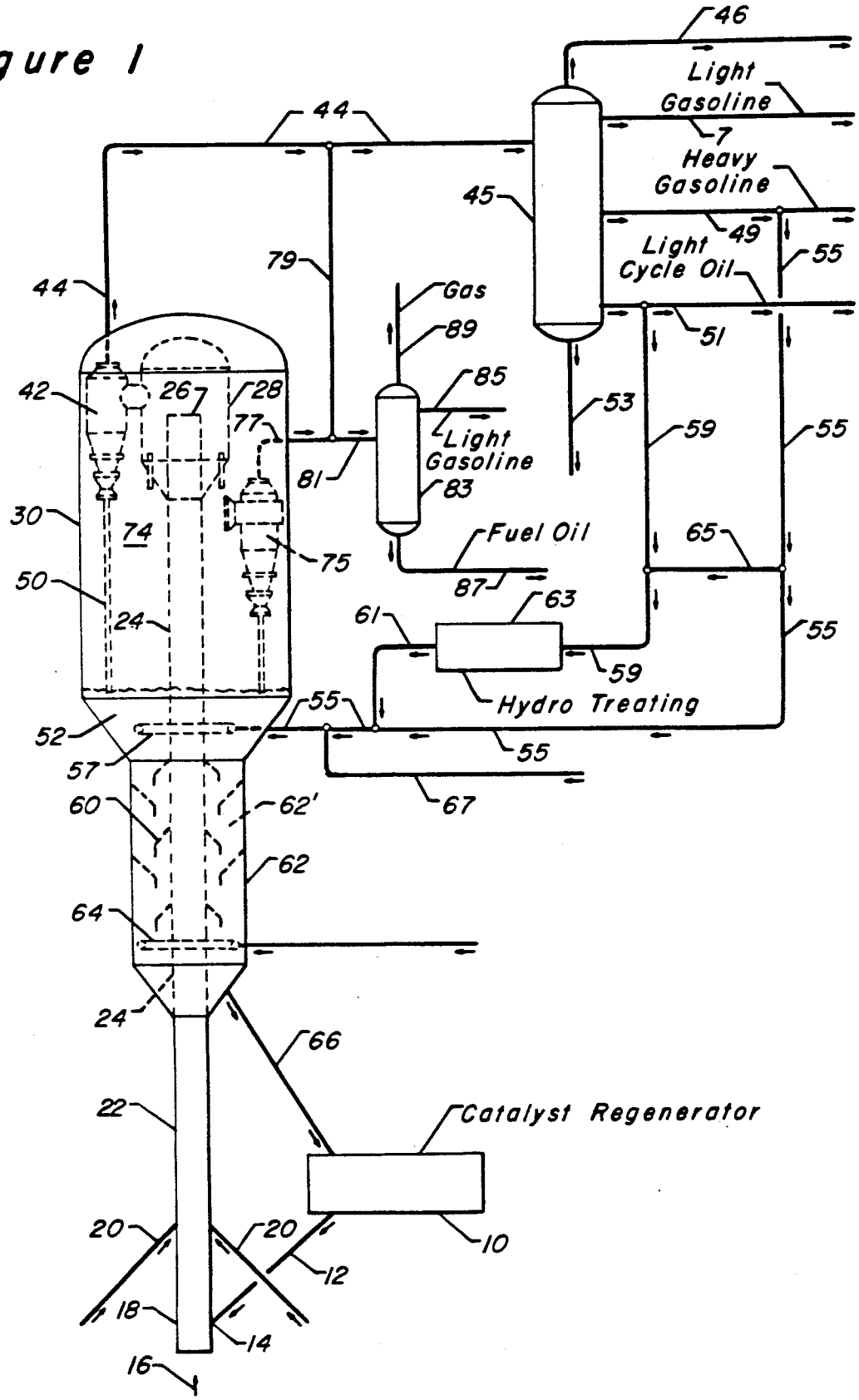
FIG. 1 is a schematic diagram of the process of this invention showing an FCC unit, a main separation zone and optional separation and treatment zones.

An overview of the basic process operation can be best understood with reference to FIG. 1. Regenerated catalyst from a catalyst regenerator 10 (shown schematically) is transferred by a conduit 12, to a Y-section 14. Lift gas injected into the bottom of Y-section 14, by a conduit 16, carries the catalyst upward through a lower riser section 18. Feed is injected into the riser above lower riser section 18 at feed injection points 20.

The mixture of feed, catalyst and lift gas travels up an intermediate section 22 of the riser and into an upper internal riser section 24 that terminates in an upwardly directed outlet end 26. Riser end 26 is located in a separation device 28 which in turn is located in a reactor vessel 30. The separation device removes a majority of the catalyst from the cracked hydrocarbon vapors that exit riser end 26. Catalyst removed by separation device 28 falls into dense catalyst bed 52. Cyclone 42 receives the cracked vapors from the separation device and removes essentially all of the remaining catalyst from the riser vapor stream. Separated catalyst from cyclone 42 drops downward into the reactor through dip legs 50 into a catalyst bed 52. Conduit 44 withdraws the riser vapors from the top of the cyclone 42 and transfers the vapors to a separation zone comprising a main column 45.

Main column 45 fractionates the feed into at least four streams. These streams will include at least, a gas stream 46, a light gasoline cut 47, a heavy gasoline cut 49, and a heavy portion comprising light cycle oil and heavier hydrocarbons which preferably leave the column in at least two cuts comprising a light cycle oil cut 51 and cycle oil and heavier hydrocarbon cut 52. Line 55 recycles at least a portion of the heavy gasoline from line 49 to the dense bed 52 via a distributor 57. In other embodiments of this invention, lines 59 and 61 recycle all or a portion of the light cycle oil to bed 52. Typically, recycled light cycle oil first undergoes hydrotreatment in a treatment zone 63 before entering bed 52. All or a portion of the heavy gasoline may also undergo hydrotreating when transferred into the hydrotreating zone by line 65. In addition to the heavy gasoline, a line 67 may transfer a benzene containing stream into bed 52.

As the secondary feed enters reactor 30 through line 55, distributor 57 disburses the feed over the bottom of bed 52. Reactor vessel 30 has an open volume above catalyst bed 52 that provides a dilute phase section 74. Catalyst cascades downward from bed 52 through a series of baffles 60 that project transversely across the cross-section of a stripping zone 62' in stripper vessel 62. Preferably, stripping zone 62' communicates directly with the bottom of reactor vessel 30 and more preferably has a sub-adjacent location relative thereto. As the catalyst falls, steam or another stripping medium from a distributor 64 rises countercurrently and contacts the catalyst to increase the stripping of adsorbed components from the surface of the catalyst. A conduit 66 conducts stripped catalyst into catalyst regenerator 10 which combustively removes coke from the surface of the catalyst to provide regenerated catalyst.

The countercurrently rising stripping medium desorbs hydrocarbons and other sorbed components from the catalyst surface and pore volume. Stripped hydrocarbons and stripping medium rise through bed 52 and combine with the secondary feed and any resulting products in the dilute phase 74 of reactor vessel 30 to form a reactor vessel product stream. At the top of dilute phase 74, an outlet withdraws the stripping medium and stripped hydrocarbons from the reactor vessel. One method of withdrawing the stripping medium and hydrocarbons is shown in FIG. 1 as cyclone 75 which separates catalyst from the reactor vessel product stream. A line 77 withdraws the reactor vessel product stream from the cyclone and out of reactor vessel 30. The reactor vessel product passes from line 77 to the main column separator via a line 79 or to a separate separation column 83 via a line 81. When present separation column 83 typically separates light and heavy fractions, via lines 89 and 87, to form a light gasoline product stream 85.

This invention can employ a wide range of commonly used FCC catalysts. These catalyst compositions include high activity crystalline alumina silicate or zeolite containing catalysts. Zeolite catalysts are preferred because of their higher intrinsic activity and their higher resistance to the deactivating effects of high temperature exposure to steam and exposure to the metals contained in most feedstocks. Zeolites are usually dispersed in a porous inorganic carrier material such as silica, aluminum, or zirconium. These catalyst compositions may have a zeolite content of 30% or more. Particularly preferred zeolites include high silica to alumina compositions such as LZ-210 and ZSM-5 type materials. Another particularly useful type of FCC catalysts comprises silicon substituted aluminas. As disclosed in U.S. Pat. No. 5,080,778, the zeolite or silicon enhanced alumina catalysts compositions may include intercalated clays, also generally known as pillared clays.

Feeds suitable for processing by this invention, include conventional FCC feedstocks or higher boiling hydrocarbon feeds. The most common of the conventional feedstocks is a vacuum gas oil which is typically a hydrocarbon material having a boiling range of from 650°-1025° F. and is prepared by vacuum fractionation of atmospheric residue. Such fractions are generally low in coke precursors and heavy metals which can deactivate the catalyst.

The invention is also useful for processing heavy or residual charge stocks, i.e., those boiling above 930° F. which frequently have a high metals content and which usually cause a high degree of coke deposition on the catalyst when cracked. Both the metals and coke deactivate the catalyst by blocking active sites on the catalyst. Coke can be removed, to a desired degree, by regeneration and its deactivating effects overcome. Metals, however, accumulate on the catalyst and poison the catalyst by fusing within the catalyst and permanently blocking reaction sites. In addition, the metals promote undesirable cracking thereby interfering with the reaction process. Thus, the presence of metals usually influences the regenerator operation, catalyst selectivity, catalyst activity, and the fresh catalyst make-up required to maintain constant activity. The contaminant metals include nickel, iron and vanadium. In general, these metals affect selectivity in the direction of less gasoline and more coke. Due to these deleterious effects, metal management procedures within or before the reaction zone may be used when processing heavy feeds by this invention. Metals passivation can also be achieved to some extent by the use of appropriate lift gas in the upstream portion of the riser.

The feed and catalyst enter a reactor riser. The reactor riser used in this invention discharges into a device that performs an initial separation between the catalyst and gaseous components in the riser. The term "gaseous components" includes lift gas, product gases and vapors, and unconverted feed components. The drawing shows this invention being used with a riser arrangement having a lift gas zone 18. A lift gas zone is not a necessity to enjoy the benefits of this invention. Preferably, the end of the riser will terminate with one or more upwardly directed openings that discharge the catalyst and gaseous mixture in an upward direction into a dilute phase section of a disengaging vessel. The open end of the riser can be of an ordinary vented riser design as described in the prior art patents of this application or of any other configuration that provides a substantial separation of catalyst from gaseous material in the dilute phase section of the reactor vessel. The flow regime within the riser will influence the separation at the end of the riser. Typically, the catalyst circulation rate through the riser and the input of feed and any lift gas that enters the riser will produce a flowing density of between 3 lbs/ft$^3$ to 20 lbs/ft$^3$ and an average velocity of about 10 ft/sec to 100 ft/sec for the catalyst and gaseous mixture. The length of the riser will usually be set to provide a residence time of between 0.5 to 10 seconds at these average flow velocity conditions. Other reaction conditions in the riser usually include a temperature of from 875°-1050° F.

Gas oil or residual feed contacting in the riser takes place under the typical short contact time conditions. Maintaining short contact times requires a quick separation of catalyst and hydrocarbons at the end of the riser. It is important to this invention that a separation device at the end of the riser provide a quick separation of the catalyst from the riser vapors and also limit the transfer of vapors from the riser into the dilute phase zone of the reactor vessel. Suitable separation devices for the end of the riser will provide a low catalyst residence time and recover at least 90 wt. % of the vapors discharged from the riser. Preferably, the separation device at the end of the riser will recover 95 wt. % of the vapors that the riser discharges. In addition, the separation device will also provide a seal that allows no more than 10 wt. % and preferably no more than 5 wt. % of the vapors from dilute phase 74 to enter the disengaging device. In this manner, at least 90 wt. % of the products from the reactor vessel reaction zone are recovered without intermixing with riser product stream.

It is not essential to this invention that any particular type of separation device receive the riser effluent. However, whatever type of riser separation device is used, it must achieve a high separation efficiency. Since the catalyst usually has a void volume which will retain up to 7 wt. % of the riser gaseous components, some of the riser gaseous components must be displaced from the catalyst void volume to achieve the preferred recovery of over 95 wt. % recovery of riser product components. A preferred manner of displacing riser gaseous components from the catalyst leaving the riser is to maintain a dense catalyst bed adjacent to the riser outlet that is separated from the larger dense bed in the reactor vessel. This dense bed location minimizes the dilute phase volume of the catalyst and riser products, thereby avoiding the aforementioned problems of prolonged catalyst contact time and overcracking. The dense bed arrangement itself reduces the concentration of riser products in the interstitial void volume to equilibrium levels by passing a displacement fluid therethrough. Maintaining a dense bed and passing a displacement fluid through the bed allows a complete displacement of the riser gaseous products. Without the dense bed, it is difficult to obtain the necessary displacement of gaseous products. Restricting the catalyst velocity through the dense bed also facilitates the displacement of riser gaseous components. The catalyst flux or catalyst velocity through the dense bed should be less than the bubble velocity through the bed. Accordingly, the catalyst velocity through the bed should not exceed 1 ft/sec. Protracted contact of the catalyst with the displacement fluid in the dense bed can also desorb additional gaseous riser products from the skeletal pore volume of the catalyst. However, the benefits of increased product recovery must be balanced against the disadvantage of additional residence time for the reactor products in the separation device.

The separation device has a location in an upper portion of the reactor vessel. As shown in FIG. 1, catalyst from the separation device drops downwardly into a dense bed 52 that is maintained in a lower portion of reactor vessel 30 and referred to as the reactor vessel reaction zone. Catalyst collecting in bed 52, although containing a relatively high coke concentration, still has sufficient surface area for catalytic use. Typically, the coke concentration of the catalyst in this bed will range from 1.5 to 0.6 wt. %. Bed 52 supplies a high inventory of catalyst that is available for contact with a secondary feed. Feed can enter the dense bed at any point below the upper surface of the dense bed. The secondary feed typically enters the lower bed through line 55 and distributor 57 as previously described. Where a subadjacent stripping vessel receives catalyst from the reactor vessel, the secondary feed may be injected into the stripper at any location including the bottom provided the injection point is above the lowermost point of steam injection.

After separation from the catalyst, the cracked vapors of the riser enter a primary product separation zone. In simplest form, the separation zone isolates a light gasoline product stream, and a heavy gasoline recycle stream from the lighter and heavier fractions of the cracked vapors. In most cases, the FCC main column will provide a suitable primary separation zone. The light gasoline fraction is typically withdrawn with an initial boiling point in the $C_5$ range and an end point in a range of 300°–400° F. and preferably at a temperature of about 380° F. The cut point for this fraction is preferably selected to retain olefins which would otherwise be lost to additional cracking to lighter components and saturation by the recycle of the heavy gasoline fraction. The heavy gasoline stream comprises the next heavier fraction boiling above the light gasoline fraction. At the operating conditions of the main column, this cut point will be at about the boiling point of $C_9$ aromatics, in particular 1,2,4-trimethylbenzene. A lower cut point temperature between the light and heavy gasoline, down to about 320° F., but preferably above 360° F., will bring additional $C_9$ aromatics into the heavy gasoline recycle stream. However, such a lower cut point also increases the olefinicity of the heavy gasoline recycle cut. Olefin recracking and hydrogen transfer reactions in the secondary bed will crack and saturate olefins to light paraffins, therefore, excessive olefin recycle with the heavy gasoline should be controlled. In its most basic form, the upper end of the heavy gasoline cut is selected to retain $C_{12}$ aromatics. The $C_{12}$ to $C_9$ aromatics in the heavy gasoline fraction are readily dealkylated. When operating in the simplest mode of this invention, higher end points for the heavy gasoline cut carry bicyclic compounds into the secondary reaction zone and bring little benefit to the process unless these bicyclic components are pretreated. These bicyclic compounds include indenes, biphenyls and naphthalenes which are refractory to cracking under the conditions in the reactor vessel reaction zone. Therefore, the heavy gasoline will usually have an end point of about 400°–430° F. and more preferably about 420° F.

The practice of this invention does not exclude the use of the reactor reaction zone for the treatment of hydrocarbon fractions having boiling points above the heavy gasoline end point. One arrangement of this invention hydrotreats the bicyclic hydrocarbons from a light cycle oil cut to saturate the rings of the indenes and naphthalenes. Light cycle oil can pass through the hydrotreatment zone as a separate stream or together with all or a portion of the heavy gasoline fraction. The light cycle oil fraction will comprise the next hydrocarbon fraction having a boiling point above the heavy gasoline stream and will usually have an end boiling point in a range of about 500°–680° F.

Hydrotreatment of the heavy gasoline cut reduces the sulfur content of the products that are withdrawn from the reactor zone. In addition to sulfur removal, it is also believed that the reaction of the heavy gasoline with the hydrotreated light cycle oil promotes hydrogen transfer from the saturated bicyclics that suppress the conversion of the heavy gasoline components to heavier hydrocarbon species and coke. In the alternative, it may be advantageous to hydrotreat the product of the heavy gasoline recycle since it contains a lighter cut of olefins that have undergone additional cracking to light saturates and allows the hydrotreatment with low hydrogen addition and no octane loss. Hydrotreatment of the heavy gasoline product after the reactor reaction zone can also provide a low hydrogen demand method of reducing olefin levels in the gasoline products.

The hydrotreatment of the light cycle oil, and any heavy gasoline fraction, takes place at low severity conditions to avoid the saturation of the single ring compounds in the heavy gasoline fraction. In the method of this invention, up to 100% of the light cycle oil is hydrotreated. Hydrotreating is carried out in the presence of a nickel-molybdenum or cobalt-molybdenum catalyst and relatively mild hydrotreating conditions including a temperature of 600°–700° F, a liquid hourly space velocity (LHSV) of from 0.2 to 2 and a pressure of 500 to 1500 psig. The hydrotreating of the light cycle oil partially saturates bicyclic hydrocarbons such as naphthalene to produce tetralin. Hydrotreatment and subsequent cracking of the light cycle oil is generally known as J-cracking. J-cracking converts light cycle oils and other hydrocarbon streams comprising multi-ring aromatic hydrocarbons that are difficult to crack in a typical FCC process. The 'J' in J-cracking is a measure of unsaturation of the hydrocarbons of the general formula:

$$C_N H_{2H-J}$$

Suitable methods for carrying out J-cracking is further described in U.S. Pat. Nos. 3,479,279 and 3,356,609 which are incorporated herein by reference.

The reactor vessel reaction zone provides ideal reaction conditions for the dealkylation of the heavy gasoline feed and the possible cracking of hydro aromatics. The small alkyl groups on the cyclic hydrocarbons become very refractory to any dealkylation, therefore, severe cracking activity is needed to partially remove these alkyl groups. Since the dealkylation reactions are slow, the long residence time of the second reaction zone provides the necessary contact time for these secondary reactions to occur. The processing of the heavy gasoline stream through the reactor vessel as an independent feed permits independent control of the feed residence time in the second reaction zone and very high catalyst to oil ratios. In most operations, the reactor vessel reaction zone will operate at a temperature of from 1020° to 900° F. or about 30° F. less than the riser reaction zone. Catalyst to oil ratios will typically range from 20 to 80 with an average residence time in the reactor reaction zone of from 2 to 200 seconds. The reaction conditions of the second reaction zone have also been found to reduce the overall sulfur concentration of the products produced in the reactor vessel reaction zone.

Another aspect of this invention recognizes the utility of charging a benzene containing feedstock into the reactor vessel reaction zone with the heavy gasoline fraction. The reactor vessel reaction zone again provides long residence time and high catalyst to oil ratio that will promote transalkylation of the benzene to $C_7$ and $C_8$ hydrocarbons. The heavy gasoline light cycle oil, or coke forming components provide a ready supply of alkyl groups for transalkylation with the benzene. Transalkylation of benzene in the reactor vessel reaction zone also minimizes the loss of light olefins from the FCC process as would otherwise occur when cracking benzene in a reactor riser. Light reformate product streams from reforming process can provide particularly useful benzene containing feedstreams.

Moreover, the isolated reactor vessel reaction zone of this invention can provide an advantageous location for the alkylation of benzene containing feeds with or without the addition of heavier FCC product fractions. Even with good initial separation and stripping of the catalyst from a riser reaction zone, the catalyst will adsorb substantial amounts of polycyclic hydrocarbons which will enter the reactor vessel reaction zone. The negativity of the polycyclic hydrocarbons further promotes their adsorption on the acidic catalyst. Therefore, the reactor vessel reaction zone will have a source of alkyl groups from the polycyclic hydrocarbons that can provide a suitable means for the independent conversion of benzene to $C_7$ and $C_8$ hydrocarbons.

Products from the reactor vessel reaction zone remain isolated from the reactor riser products as long as catalyst contacts either one of the product streams. Mixing of the two product streams in the presence of catalyst will promote hydrogen transfer reactions that can cause the loss of valuable product components such as olefins. After separation of the products from the catalyst, the riser products and the reactor vessel products can be combined and recovered in a common separation zone. Accordingly, a single main column separation zone can receive both product streams and separate the combined product stream into the aforementioned light gasoline and heavy gasoline streams along with any additional product cuts such as the light cycle oil stream. Separating all of the products in a single separation zone has the advantage of reducing equipment and maximizing the recycle of heavy gasoline components. A single separation zone has the disadvantage of allowing the build-up of certain refractory compounds in the recycle loop. Biphenyls comprise one such compound that boils with the light cycle oil and undergoes no conversion in the hydrogenation zone or reactor vessel. Thus, a single separation zone requires appropriate facilities to remove refractory components such as the taking of a drag stream. Processing only the heavy gasoline stream in the reactor vessel reaction zone will minimize the build-up of refractory compounds. Therefore, the single separation zone arrangement is most suited for operations that only recycle a narrow heavy gasoline cut.

In a preferred form of this invention, the reactor vessel product stream is recovered by an additional separation zone. The separate separation zone has several advantages. Since the reaction of the heavy gasoline fraction in the reactor vessel can lower sulfur concentration in the reactor vessel products by as much as 50%, recovery of the reactor vessel product stream by an additional separation zone provides a source of low sulfur products. These products can include a low sulfur light gasoline and low sulfur fuel oil. A distinct separation zone for the reactor vessel product stream also permits the incorporation of this invention into existing facilities where the main column could not otherwise accept additional throughput.

The independent separation of the reactor vessel product stream also offers the unexpected advantage of a source of hydrogen. While in most cases the presence of metals degrades the FCC operation by the aforementioned catalyst deactivation and overcracking of products, the process of this invention may derive a benefit from a controlled concentration of nickel on the catalyst. Nickel, present in moderate amounts, will promote cracking of alkyl groups from the heavy cyclic hydrocarbons that are adsorbed on the catalyst. This light hydrocarbon stream contains a relatively high concentration of hydrogen. By recovering a separate product stream from reactor vessel, a light gas stream containing a high concentration of hydrogen is easily separated from the reactor vessel product stream.

Figure 2:
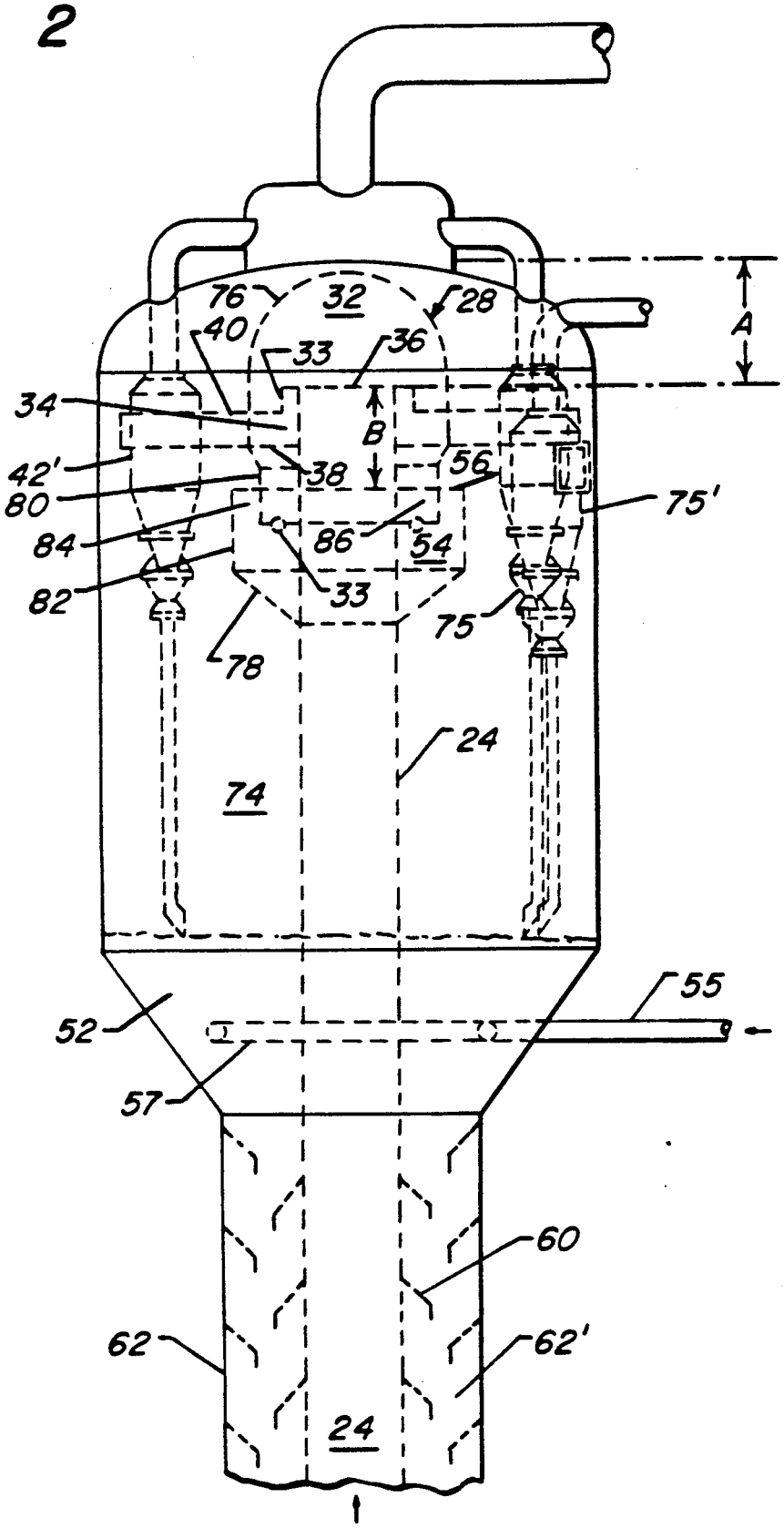
FIG. 2 is a sectional elevation of a reactor showing an arrangement of internals that is particularly suited for providing the independent dealkylation reaction zone of this invention.

FIG. 2 depicts a particularly useful type of separation device for the end of the riser that employs a dense bed at the end of the riser. In this arrangement, catalyst and vapors leave the top of riser 24. The gas and catalyst are separated in dilute phase section 32 of the disengaging device 28. Disengaging device 28 has disengaging vessel defined by an upper shell section 76 and a lower shell section 78. The top of reactor vessel 30 supports upper section 76 of the disengaging vessel. A rigid connection attaches lower section 78 to reactor/riser 24. Upper section 76 and lower section 78 provide substantially closed sidewalls and a substantially closed top. Substantially is defined to mean that the surface is impervious to fluid passage except for nozzles or passages of relatively small cross-section. A lower section 80 of upper section 74 extends into a larger upper portion 82 of lower section 78. A gap between lower portion 80 and upper portion 82 defines an annular chamber 84 having an upper open end that provides opening 56. Opening 56 has a restricted size relative to the cross-section of the disengaging vessel and throttles catalyst out of the disengaging vessel at a controlled rate. The gap between the upper and lower sections of the disengaging vessel permits differential expansion between these sections which are supported from the reactor vessel and riser, respectively. Lower portion 80 together with the outside of riser 24 defines another annular chamber 86. Catalyst flowing out of the disengager vessel passes first through annular chamber 86 and then back up to chamber 84 in a labyrinthine path. The top of lower portion 82 establishes the upper bed level of a dense catalyst bed 54 in the disengaging vessel. The restricted opening 56 along with the downward flow of catalyst through annular section 86 and upward through annular section 84 will maintain a catalyst seal between dilute phase 32 and dilute phase 74. Most stripping that occurs in bed 54 takes place between a distributor ring 33 that passes stripping fluid into bed 54 and the top of bed 54. Lower wall section 80 seals the dilute phase section 32 of disengaging vessel and segregates displacement fluid and stripped hydrocarbons from the catalyst flowing out of opening 56. Catalyst separated in disengaging device 28 drops from dilute phase section 32 into dilute phase section 74 and catalyst bed 54. Catalyst bed 54 is preferably maintained as a dense bed which is defined to mean a catalyst bed with a density of at least 20 $lbs/ft^3$. Segregation of the riser gaseous components and displacement medium in the disengaging vessel lowers the concentration of hydrocarbons in the dilute phase 74.

In disengaging vessel type separator of FIG. 2, a collector cup 33 surrounds the outlet end 26 of the riser.

Collector cup 33 defines an annular chamber 34 and has an open top 36 and a substantially closed bottom 38. Chamber 34 collects the separated gases from dilute phase 32. The separation device of FIG. 2 again includes one or more cyclones. Conduits 40 transfer the gas plus a small amount of entrained catalyst to cyclone separators 42'.

For the disengaging vessel arrangement of FIG. 2, the velocity at which the catalyst and gaseous mixtures discharge from end 26 of the riser also influences the placement of the end of the riser relative to the top of the disengaging vessel. This distance indicated by the letter "N" in FIG. 2 is set on the basis of the flow rate to riser. In the interest of minimizing the dilute volume of catalyst in the disengaging vessel, distance "A" should be kept as short as possible. Nevertheless, there is need for some space between the end of the riser and the top of the disengagement vessel. Providing a distance as defined by dimension A avoids direct impingement and the resulting erosion of the top of the reactor vessel. Moreover, the discharge of catalyst from the end of the riser requires a space to provide a separation while preventing the re-entrainment of catalyst particles with the gas stream collected by cup 33. Since the reactor riser is usually designed for a narrow range of exit velocities between 20 to 100 ft/sec, distance "A" can be set on the basis of riser diameter. The avoidance of catalyst re-entrainment after discharge of the riser is influenced by both the riser velocity and the flowing density of the catalyst as it passes downward through the reactor vessel. For most practical ranges of catalyst density in the riser, the distance of 1 to 5 riser diameters, and preferably 1 to 2 riser diameters, for dimension "A" is adequate for a flowing catalyst density, often referred to as "catalyst flux," of about 50–200 lbs/ft$^2$/sec.

In the disengager vessel type separator, the total volume of the vessel is determined by the diameter of the disengager vessel, the distance from the end of the riser to the top of the disengager vessel, dimension "A," and the distance from the discharge end of the riser to the top of the dense bed level in the reactor vessel which is shown as dimension "B" in FIG. 1. In order to minimize re-entrainment of catalyst particles into the any gases that rise from catalyst bed 54, a vertical space must separate riser end 26 and the upper level of bed 54. The desired length of this space, represented by dimension B, is primarily influenced by the superficial velocity of the gases that flow upwardly through dense bed 50. A superficial velocity typically below 0.5 ft/sec will minimize the potential for re-entrainment of the gaseous compounds passing through bed 54. The gaseous components passing upwarc through bed 54 comprise at least hydrocarbons that are desorbed from the surface of the catalyst.

In the disengaging device 28, st.ipping or displacement medium enters and passes upwardly out bed 54. The amount of stripping gas entering the typical stripping vessel is usually proportional to the volume of voids in the catalyst. In this invention, it is preferred that the amount of stripping gas entering the disengaging vessel be adequate to displace hydrocarbons from the interstitial void area of the catalyst. For most reasonable catalyst to oil ratios in the riser, the amount of stripping gas that must be added to displace the interstitial void volume of the catalyst will be about 1 wt. % of the feed. It is essential to the disengaging device of FIG. 2 that the catalyst in the bottom of the disengager vessel be maintained as a dense bed. The dense bed minimizes the interstitial voidage of the catalyst. At dense conditions, the catalyst bed operates in a bubble phase where gas moves upwardly relative to the catalyst bed. In order to keep gas passing upwardly and out of the bed, the downward catalyst in the bed must not exceed the approximately 1 foot per second relative upward velocity of the gas bubbles. Since the removal of the product vapors from the interstitial voids of the catalyst is dependent on equilibrium, a higher steam rate through the dense bed can recover additional amounts of product hydrocarbons from the interstitial as well as the skeletal voids of the catalyst. As more stripping medium enters the disengaging vessel, it will provide a more complete stripping function. However, as the addition of stripping medium to the dense bed increases so does the entrainment of catalyst out of the bed and the carryover of catalyst into the cyclone system. Thus, thorough stripping in the disengager vessel increases the gas flow rate through the disengaging vessel and usually the length of dimension B. Consequently, the benefits of more complete stripping come at the expense of additional dilute phase volume in the disengaging vessel. As long as the superficial velocity of the gases rising through bed 50 stays below 0.5 ft/sec and preferably below about 0.1 ft/sec, a dimension B of 2 feet, and more preferably 4 feet, which roughly equates to 1 to 2 riser diameters, will prevent substantial re-entrainment of the catalyst and the gases exiting the reactor vessel. The primary variable in controlling the superficial gas velocity upward through the dense catalyst bed is the diameter of the disengager vessel. Balancing of a lowered superficial velocity against the disengager volume is again required. Normally, the disengager vessel will have a diameter of from 2 to 5 times the riser diameter.

EXAMPLE

The following example shows that a secondary reaction zone that operates with spent catalyst from a riser type reaction zone can effect significant boiling point reductions of heavy gasoline feeds. In this example, a sample of equilibrium catalyst containing an average of 0.8 wt. % coke was used to contact a heavy gasoline feed. The feed had the properties listed in Table 1. The coked catalyst contacted the feed in a fixed bed reaction zone at a WHSV of 1.0, a Catalyst to Oil ratio of 6.0 and a temperature of 981° F. A product stream having the composition given in Table 2 was recovered from the reaction zone.

TABLE 1

| | |
|---|---|
| IPB | 320° F. |
| EBP | 420° F. |
| RON | 90.2 |
| MON | 80.6 |
| PARAFFINS & NAPHTHENES | 27.7 wt. % |
| OLEFINS | 9.5 wt. % |
| AROMATICS | 65.8 wt. % |
| S | 0.12 wt. % |

TABLE 2

| PRODUCTS (wt. %) | |
|---|---|
| $H_2$ | 0.17 |
| $(C_1 + C_2)$ | 3.60 |
| $C_3$ | 2.12 |
| $C_3 =$ | 2.40 |
| $C_4$ | 2.97 |
| $C_4 =$ | 1.11 |
| LIGHT GASOLINE ($C_5$-320° F.) | 28.53 |
| HEAVY GASOLINE | 40.96 |
| 430+ | 11.37 |

TABLE 2-continued

| PRODUCTS (wt. %) | |
|---|---|
| COKE | 7.7 |
| CONVERSION | 47.7 |
| RONC | 100.0 |
| MONC | 90.0 |
| S wt. % | 0.05 |
| N ppm | 40 |

Table 2 demonstrates that contact of the feed with the coked catalyst provided a substantial conversion of the heavy gasoline to light gasoline components. The conversion listed in Table 2 represents the reduction in the amount of product boiling over 320° F. The substantial conversion occurred at a relatively low space velocity. In addition, this example used, as the heavy gasoline component, a cut having an initial boiling point at the very low end of the temperature range for such feedstreams. Processing of higher boiling heavy gasoline fractions and using longer catalyst residence times and higher catalyst to oil ratios are expected to provide even better conversions.

The foregoing description sets forth essential features of this invention which can be adapted to a variety of applications and arrangements without departing from the scope and spirit of the claims hereafter presented.

We claim:

1. A process for the fluidized catalytic cracking (FCC) of an FCC feedstock selected from the group consisting of gas oils and residual hydrocarbons and the production of low boiling end point gasoline, said process comprising:

(a) passing said FCC feedstock and regenerated catalyst particles to a reactor riser and transporting said catalyst and feedstock upwardly through said riser thereby converting said feedstock to a riser gaseous product stream and producing partially spent catalyst particles by the deposition of coke on said regenerated catalyst particles;

(b) discharging a mixture of partially spent catalyst particles and gaseous products from a discharge end of said riser directly into a separation zone and recovering at least 90 wt % of the riser gaseous products from said riser in said separation zone;

(c) withdrawing said recovered riser gaseous products from said separation zone through a first gas outlet;

(d) separating said riser gaseous products from said first outlet into a first product stream comprising light gasoline having an end boiling point at a first temperature in a range of 300° F. to about 400° F., a heavy gasoline feed comprising $C_9$ aromatics and having an initial boiling point at about said first temperature and an end boiling point at a second temperature of above 400° F., and a first cycle oil stream having an initial boiling point at about said second temperature;

(e) passing said partially spent catalyst and not more than 10 wt % of the reactor riser gaseous products from said separation zone into a reaction vessel, maintaining a dense bed of catalyst in said reaction vessel and contacting said heavy gasoline feed with said partially spent catalyst in said dense bed of said reaction vessel to dealkylate said $C_9$ aromatics and produce a reactor vessel product stream comprising $C_7$ and $C_8$ aromatics;

(f) withdrawing at least 90 wt % of said reactor vessel product stream from said reactor vessel through a second outlet;

(g) passing spent catalyst from said reactor vessel into a regeneration zone and contacting said spent catalyst with a regeneration gas in said regeneration zone to combust coke from said catalyst particles and produce regenerated catalyst particles for transfer to said reactor riser; and, (h) separating said reactor vessel product stream to recover additional light gasoline product having an end boiling point below said second temperature.

2. The process of claim 1 wherein a stripping zone is located subadjacent to said reactor vessel, said catalyst is passed from said reactor vessel to said stripping zone, a stripping fluid is passed upwardly through said stripping zone and said spent catalyst is transferred from said stripping zone to said regeneration vessel.

3. The process of claim 2 wherein said heavy gasoline feed is injected into the bottom of said stripping zone.

4. The process of claim 1 wherein said separation zone comprises a disengaging zone, said riser extends into said separation zone, said partially spent catalyst and said riser gaseous products are discharged directly into said disengaging vessel.

5. The process of claim 4 wherein said disengaging zone is located in said reactor vessel.

6. The process of claim 5 wherein a dense bed of said partially spent catalyst is maintained in said disengaging zone and a stripping medium passes upwardly through said dense bed of catalyst in said disengaging zone and is withdrawn with said riser gaseous products.

7. The process of claim 6 wherein said separation zone includes a riser disengaging zone, said riser has an open discharge end that upwardly discharges said spent catalyst and said riser gaseous products into a disengaging vessel, riser gaseous products and catalyst are transferred from said disengaging vessel to a cyclone separator, said riser gaseous products are withdrawn from said cyclone separator through said first outlet, and partially spent catalyst from said cyclone separator is discharged into said reactor vessel.

8. The process of claim 1 wherein said separation zone is located inside said reactor vessel, said separation zone has an interior volume maintained at a first pressure and the interior of said reactor vessel is maintained at a second pressure that is lower than said first pressure.

9. The process of claim 1 wherein said heavy gasoline feed comprises $C_{10}$ and higher carbon number cyclic hydrocarbons.

10. The process of claim 1 wherein a light cycle oil stream having an end boiling point in a range of 500°-650° F. is separated from said riser gaseous products and contacted with catalyst in said dense bed of said reaction vessel.

11. The process of claim 10 wherein said light cycle oil stream passes through a hydrotreating zone before entering said dense bed of said reaction vessel.

12. The process of claim 1 wherein said riser product stream enters a first separation zone, said reactor vessel product stream enters a second separation zone and a second product stream comprising a light gasoline having an end boiling point of less than 400° F. is withdrawn from said second separation zone.

13. The process of 91 claim 1 wherein a benzene containing stream is passed to said dense bed of said reaction vessel and alkylated to produce $C_7$ and $C_8$ aromatics.

14. The process of claim 13 wherein said benzene containing stream is a light reformate stream.

15. The process of claim 12 wherein said catalyst in said dense bed of said reactor vessel contains nickel and a third product stream comprising hydrogen is recovered from said second separation zone.

16. The process of claim 1 wherein said additional light gasoline product is hydrotreated.

* * * * *